US005833201A

United States Patent [19]

Graybill

[11] Patent Number: 5,833,201

[45] Date of Patent: Nov. 10, 1998

[54] COLLAPSIBLE EASEL FOR ARTISTS

[76] Inventor: David M. Graybill, 8103 50th St. Circle East, Sarasota, Fla. 34243

[21] Appl. No.: 577,423

[22] Filed: Dec. 22, 1995

[51] Int. Cl.[6] ..... A47B 97/04

[52] U.S. Cl. ..... 248/462; 248/460

[58] Field of Search ..... 248/460, 461, 248/462, 463, 464, 465; 312/231, 230, 232, 233, 244

[56] References Cited

U.S. PATENT DOCUMENTS

| | | | |
|---|---|---|---|
| 2,751,271 | 6/1956 | Dessertenne | 312/231 |
| 3,145,966 | 8/1964 | Landon | 248/464 |
| 3,202,471 | 8/1965 | Wilson | 312/231 |
| 3,476,456 | 11/1969 | Canavan | 312/244 |
| 3,540,787 | 11/1970 | Ford | 312/244 |
| 3,669,227 | 6/1972 | Alford | 248/461 |
| 4,149,763 | 4/1979 | Delahaie | 248/449 |
| 4,372,630 | 2/1983 | Fuhri | 312/231 |
| 4,453,470 | 6/1984 | Capella | 108/26 |
| 4,714,224 | 12/1987 | Calmes | 248/465 |
| 5,205,526 | 4/1993 | Deutsch | 248/449 |

FOREIGN PATENT DOCUMENTS

| | | | |
|---|---|---|---|
| 1363532 | 6/1963 | France | 248/461 |

*Primary Examiner*—Ramon O. Ramirez
*Assistant Examiner*—Gwendolyn W. Baxter
*Attorney, Agent, or Firm*—Charles J. Prescott

[57] ABSTRACT

A portable collapsible easel for use by an artist including a lower base member for storing artist materials and the like and a two-piece cover positionable over the open upper surface of the base member when not in use. Adjustable length support legs are connected to the base member for pivotal movement and downwardly extension from a storage position against the base member to an in-use position supporting the base member generally horizontally above the ground. The cover, having a support panel pivotally connected to a larger easel back panel, is pivotally movable in two stages form the stored or closed position to the open in-use position wherein the support panel laterally extends from, and is supported directly adjacent the lower base member. The easel back member is supported by the support member at an acute angle therebetween adjacent the lower base member so that the artist may stand or sit directly facing, and in close proximity to, the easel back panel having the lower base member at one side for ready access to the artist materials.

3 Claims, 5 Drawing Sheets

COLLAPSIBLE EASEL FOR ARTISTS

BACKGROUND OF THE INVENTION

1. Scope of Invention

This invention relates generally to artisTs' easels, and more particularly to a collapsible, portable artist's easel which allows the artist to stand or sit directly in front of the supported working surface.

2. Prior Art

Portable, collapsible and adjustable artist's easels are well known. Such devices typically allow the artist to carry artist's materials in an enclosure to a remote site and then to erect such easels for use in preparing art work while viewing the subject matter directly. Examples of such prior art known to applicant are disclosed in the following U.S Pat. Nos.:

4,714,224 Calmes 4,453,470 Capella 4,372,630 Fuhri 3,202,471 Wilson 3,145,966 Landon 5,205,526 Deutsch However, none of these prior art easels provide portability and collapsibility for easy transporting to on-site locations while also allowing the artist to stand or sit directly in front of and in close proximity facing the easel working surface while conveniently also having access to the artist's materials without undue movement or motions. The present invention resolves this drawback of prior art by providing such a portable and easily erectable and collapsible easel as disclosed herebelow.

BRIEF SUMMARY OF THE INVENTION

This invention is directed to a portable collapsible easel for use by an artist including a lower base member for storing artist materials and the like and a two-piece cover positionable over the open upper surface of the base member when not in use. Adjustable length support legs are connected to the base member for pivotal movement and downward extension from a storage position against the base member to an in-use position supporting the base member generally horizontally above the ground. The cover, having a support panel pivotally connected to a larger easel back panel, is pivotally movable in two stages form the stored or closed position to the open in-use position wherein the support panel laterally extends from, and is supported directly adjacent the lower base member. The easel back member is supported by the support member at an acute angle therebetween adjacent the lower base member so that the artist may stand or sit directly facing and in close proximity to, the easel back panel having the lower base member at one side for ready access to the artist materials.

It is therefore an object of this invention to provide a collapsible easel for artists which may contain and transport artist's materials and is easily deployable at any on-site location during use.

It is yet another object of this invention to provide a collapsible easel for artists which, when erected on site, presents an easel working surface which is directly accessible to the artist without any interference from other components thereof.

It is still another object of this invention to provide a portable easel for artists which will enclose artist's materials during transport and is easily erectable to provide an easel working surface before which the artist may directly stand.

In accordance with these and other objects which will become apparent hereinafter, the instant invention will now be described with reference to the accompanying drawings.

DETAILED DESCRIPTION OF THE INVENTION

Figure 1:
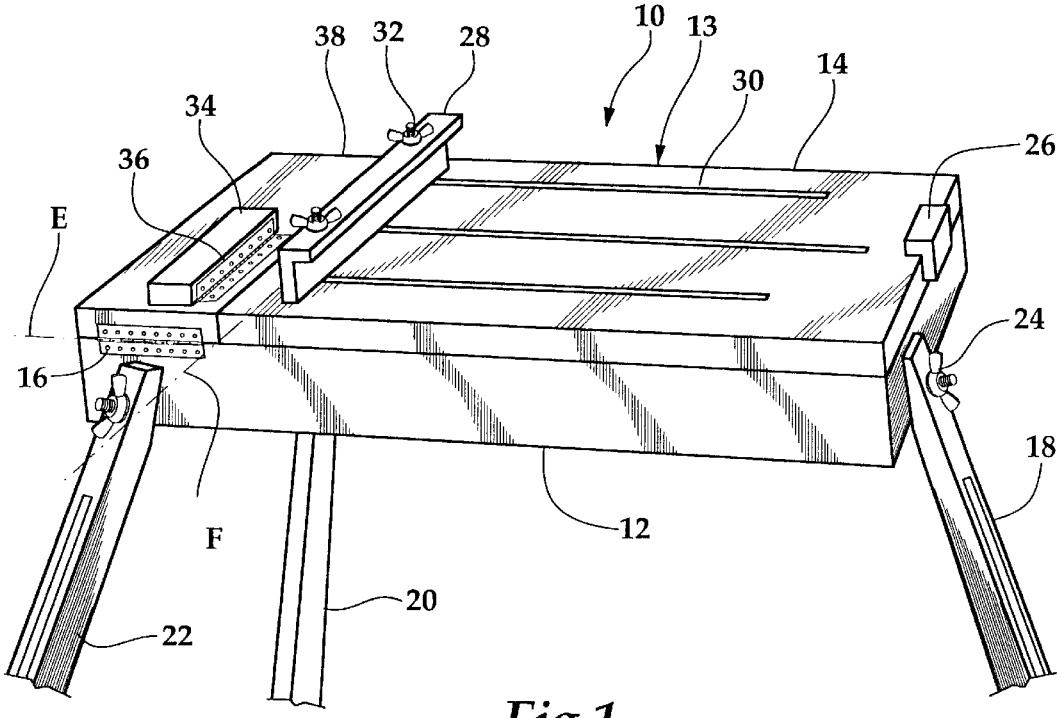
FIG. 1 is a left side perspective view of the invention in its partially erected configuration.

Referring now to the drawings, the invention is shown generally at numeral 10 in its partially deployed or erected configuration in FIG. 1 wherein the collapsible removable legs 18, 20 and 22 are connected by a bolt and wing nut arrangement 24 to, and downwardly extend from, a lower base 12 of generally rectangular configuration and having an open upper rectangular margin defined by the lower base member 12.

The invention 10 also includes a multi-function rectangular cover 13 comprising an easel back member 14 and a support member 38, the easel back member 14 being of similar width, but substantially longer in length than the support member 38. The support member 38 is pivotally connected by hinge 16 to one of the upstanding side panels of lower base member 12 adjacent one corner thereof as shown. This permits the pivotal movement of the support member 38 about axis E, the hinge 16 being external, which allows pivotal movement of the support member 38 through an arc of approximately half of a circle or 180°.

Figure 2:
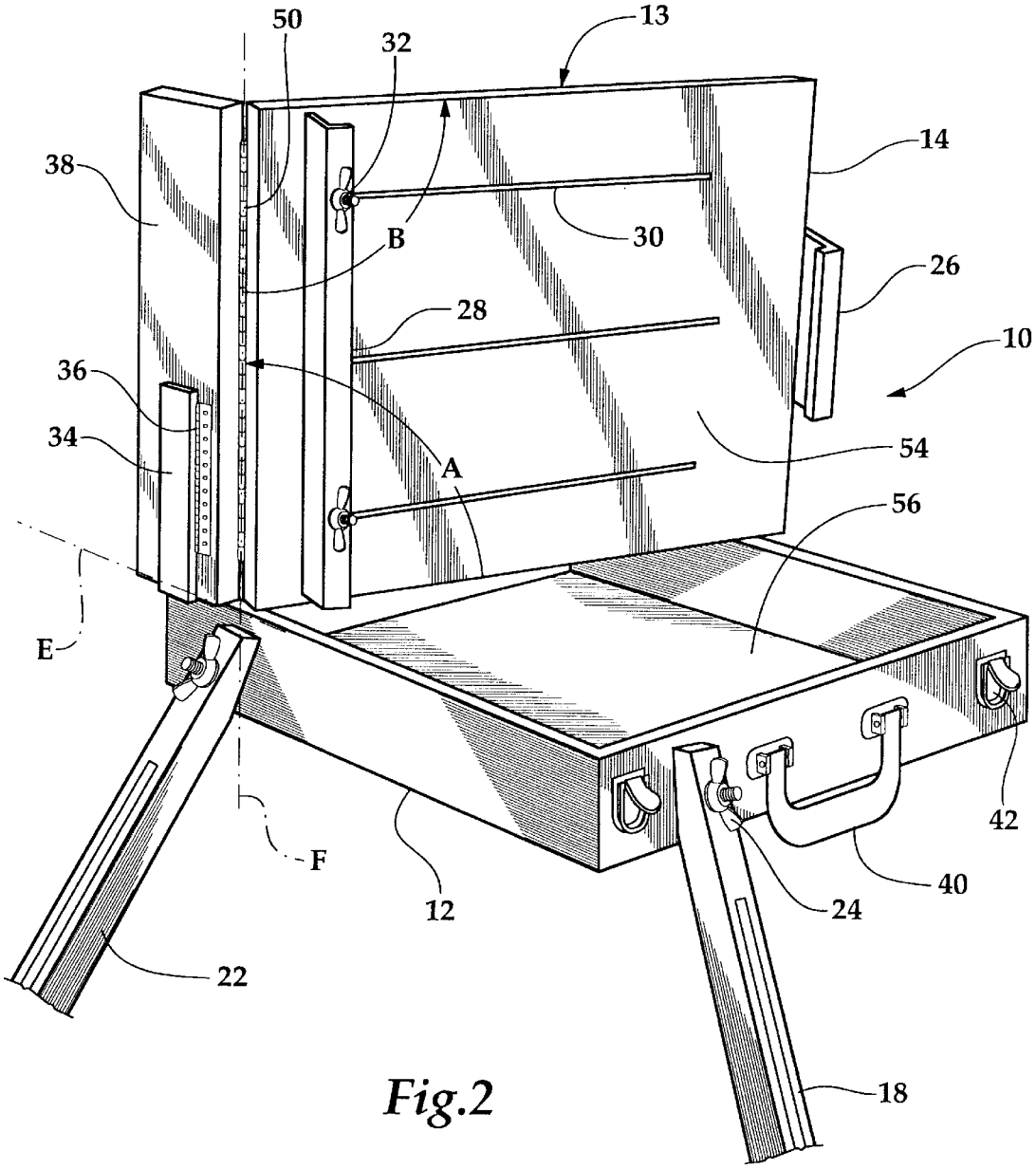
FIG. 2 is a perspective view similar to FIG. 1 in a further stage of deployment.

As best seen in FIG. 2, the easel back member 14 is hingedly connected along a common end margin by hinge member 50 to the mating edge of support member 38. When the cover 13 is in its closed position in FIG. 1, hinge 50 is downwardly facing and concealed.

To fully erect the device 10 from that partially deployed closed configuration shown in FIG. 1, the support member 38 is initially pivoted about axis E to the position shown in FIG. 2 through arc A. Thereafter, the easel back member 14 is pivoted about pivotal axis F in the direction of arrow B. Finally, after downwardly rotating support 34 about its hinged connection 36 in the direction of arrow K in FIG. 3, to contact against a side wall of the lower base member 12 at 52 the entire cover 13 is then further rotated in the direction of arrow C in FIG. 3 to its fully deployed position. Support member 38 is thus supported in its fully laterally extending position alongside of lower base member 12 by support 34 and the easel back member 14 is supported in any desired angular orientation with respect to support member 38 by a telescoping support rod 44 which is hingedly connected at 46 and 48 to leg 22 and easel back member 14, respectively.

Moreover, angular orientation of the easel back member 14 is adjustably controlled by the telescopic adjustment in the direction of arrow G of adjustable rod member 44.

Figure 3:
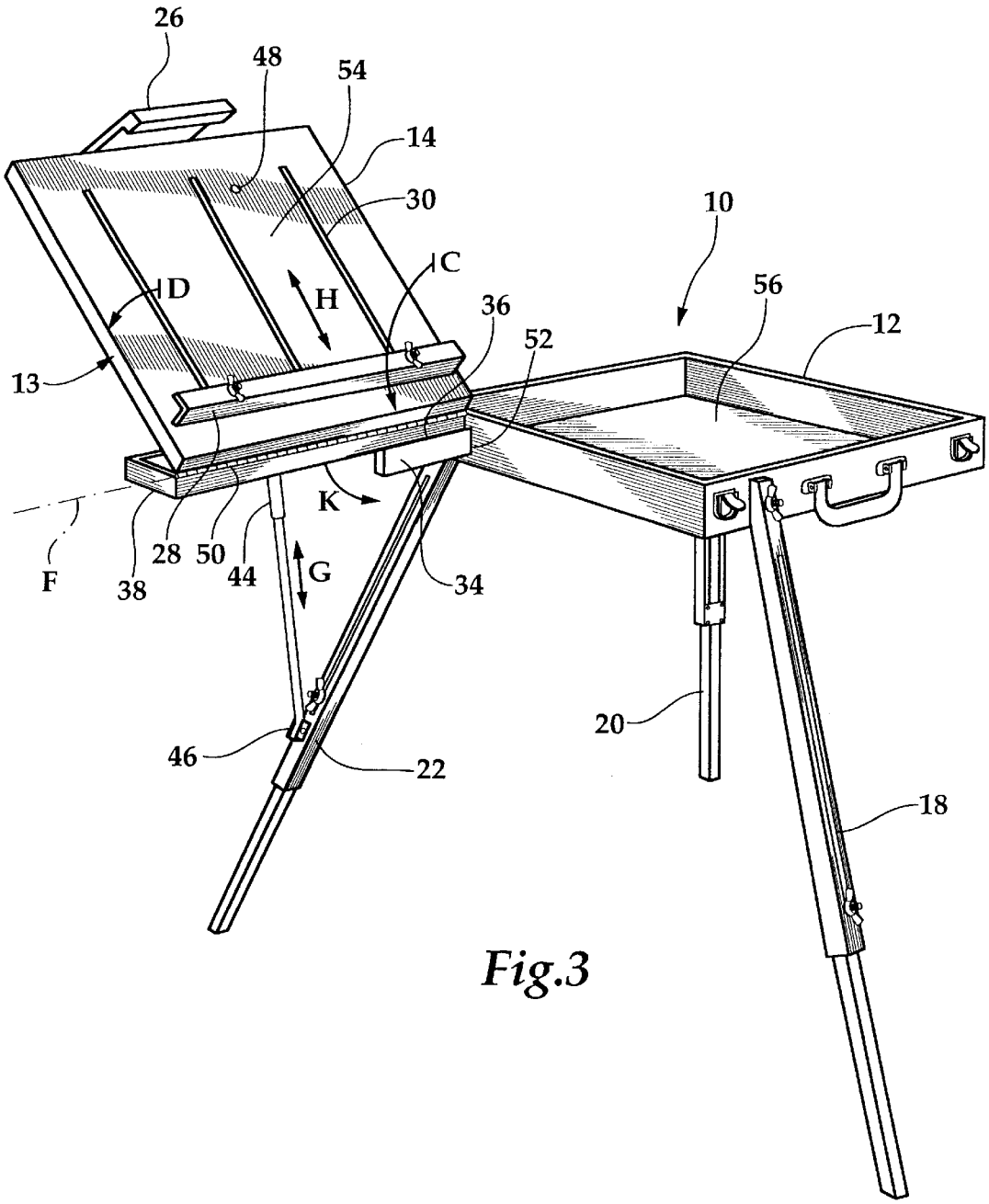
FIG. 3 is a perspective view similar to FIG. 2 fully deployed.

Easel back member 14 defines a canvas or other working paper support 54 and includes a lower paper support bar 28 which is movable up and down within slot 30 in the direction of arrow H in FIG. 3 and lockable in that position by the wing nuts 32 as shown. The upper margin of the canvas is retained by L-bracket 26 rigidly connected at the upper margin of the easel back member 14.

Figure 4:
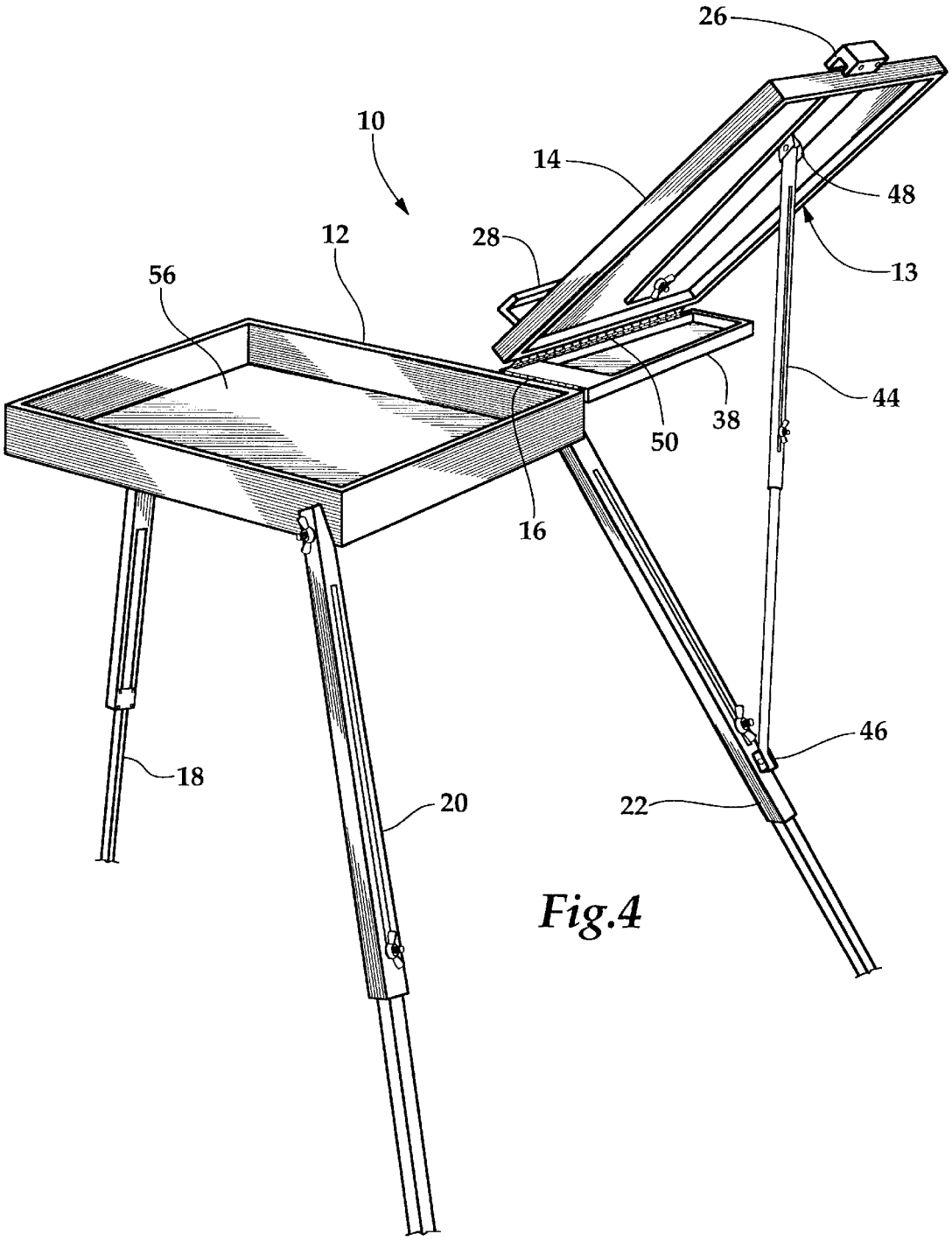
FIG. 4 is a right rear perspective view of the invention in FIG. 3.
Figure 5:
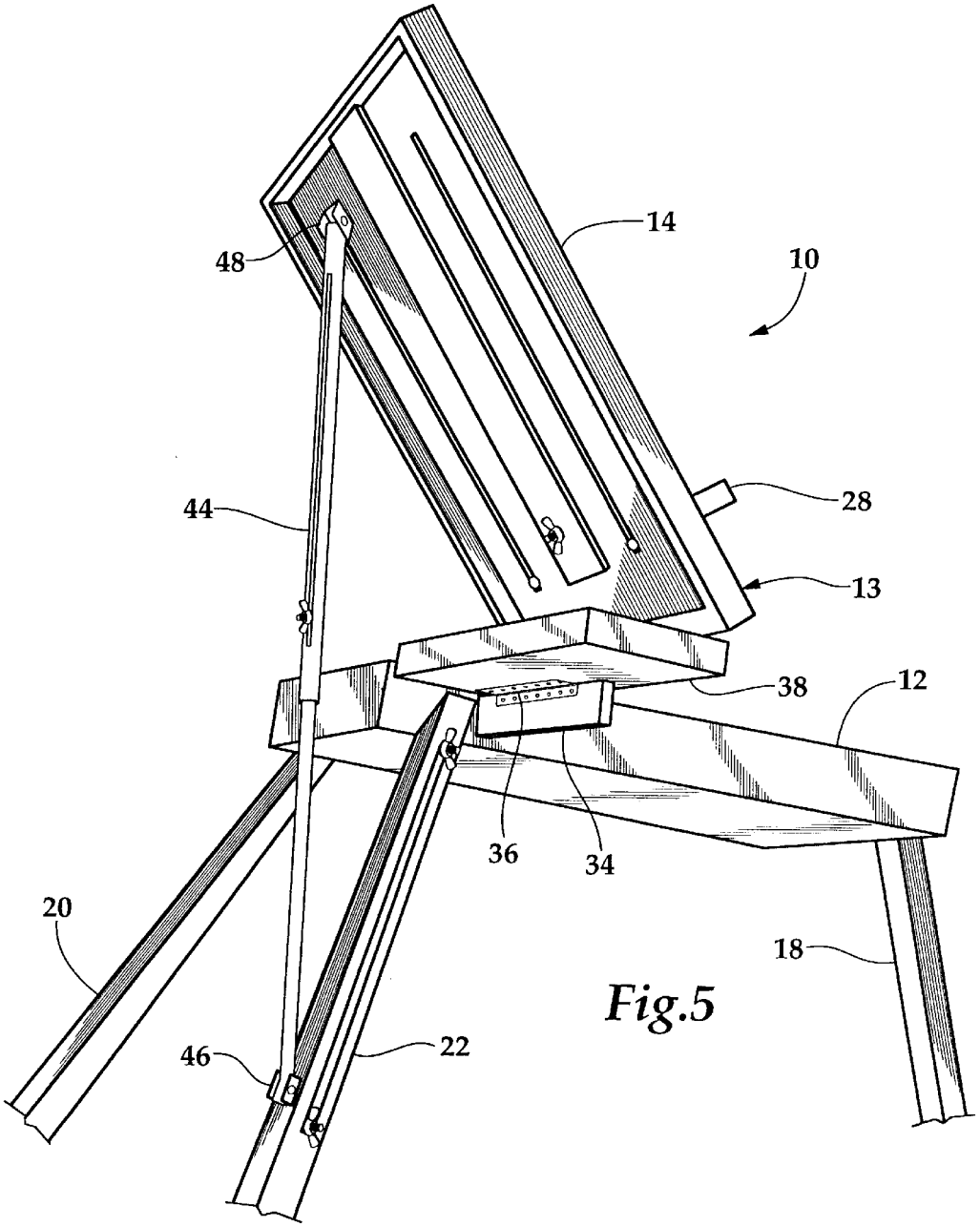
FIG. 5 is a left rear perspective view of the invention as shown in FIG. 3.

When in the open, deployed configuration, the lower base member 12, containing artist's materials therewithin at 56, is readily accessible to an artist who now may position him or herself directly in front of, and in close proximity facing the easel back member 14 without having to reach forward toward the canvas during painting and sketching. Whereas other prior art portable and collapsible easels require that the artist stand spaced from the canvas during painting and sketching activity, the present invention as clearly shown typically in FIGS. 3, 4 and 5 allows the user to stand or sit as close to the canvas supported on easel back member 14 as desired while still having ready access to the contents of the lower base member 12 without undue body movement.

When fully collapsed and closed, locking members 42 secure the cover 13 in its closed position shown in FIG. 1 while handle 40 allows for easy transportability.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A collapsible easel comprising:

a lower storage base having a generally planar upwardly facing opening and an upper cover closably positionable atop said opening;

support legs connected to, and for supporting, said lower storage base in a generally horizontal position when in use;

said upper cover having an upper surface and including a support panel and an easel back panel hingedly connected together end to end about a first pivotal axis by a first hinge means, said support panel being somewhat shorter in length than that of said easel back panel;

a work product support means connected near one end of said easel back panel adjacent said first hinge means and extending from said upper surface;

said support panel hingedly connected at one end thereof to said lower storage base about a second pivotal axis by a second hinge means positioned adjacent one corner of said lower storage base lower base;

said first and second pivotal axes oriented substantially orthogonal one to another;

said support panel pivotable about said second hinge means between a closed position atop said lower storage base and an open in-use generally horizontal position extending directly laterally from said one corner and wherein said easel back panel is pivoted about said first hinge means to a diagonally upwardly extending in-use position;

a support member connected in use between one said support leg and said easel back panel for supporting said easel back panel in the in-use position.

2. A portable easel comprising:

a lower rectangular storage base having upwardly extending side and end walls which define a generally planar upwardly facing opening;

means for supporting said storage base in a generally horizontal in-use position;

a flat, elongated support panel pivotally connected at one end thereof to said opening at an end portion of one said side wall adjacent a corresponding corner of said base;

said support panel pivotable about a first pivotal axis generally through an arc of about half a circle between a closed position atop said opening and an open in-use position laterally extending from said corner;

means for supporting said support panel in the open in-use position;

a rectangular easel back panel sized longer in length than, and similar in width to, said support panel, said easel back panel pivotally connected end to end to said support panel, said easel back panel pivotable with respect to said support panel about a second pivotal axis generally through an arc of half a circle between a closed position covering said opening and the open in-use position at an acute angle with respect to said support panel said easel back panel being positioned laterally adjacent to said storage base when in the in-use position;

said first pivotal axis oriented substantially perpendicular to said second pivotal axis;

means for adjustably supporting said easel back panel in the open in-use position.

3. A collapsible easel and storage unit for artist materials comprising, in combination:

a lower storage means for holding the artist materials, said storage means having an open upper margin;

cover means including an easel back means defining a flat working surface for supporting a painting canvas and the like when in an in-use position and for covering said open upper margin when closed;

first means for pivotally connecting a support panel defined by one end portion of said cover means to said storage means along a portion of said upper margin adjacent one corner of said easel back means;

second means for pivotally connecting said support panel to said easel back means;

said first and second pivotal connection means arranged substantially orthogonally one to another such that, when said cover means is first pivoted from a closed position about a first axis of said first pivotal connection means and then said easel back means is pivoted away from a plane of said support member about a second axis of said second pivotal connection means, said easel back means is thereby positioned in the in-use position adjacent to said storage means and at an acute included angle with respect to said support member;

means for supporting said easel back means and said support member in the in-use position.

* * * * *